United States Patent [19]

Takano et al.

[11] Patent Number: 4,601,568

[45] Date of Patent: Jul. 22, 1986

[54] DOCUMENT-SCANNING CONTROL APPARATUS FOR IMAGE-FORMING APPARATUS

[75] Inventors: Shoji Takano, Kawasaki; Fumitō Ide, Zama, both of Japan

[73] Assignee: Kabushiki Kaisha Toshiba, Kawasaki, Japan

[21] Appl. No.: 664,294

[22] Filed: Oct. 24, 1984

[30] Foreign Application Priority Data

Oct. 26, 1983 [JP] Japan ..... 58-200207

[51] Int. Cl.[4] ..... G03G 15/00

[52] U.S. Cl. ..... 355/8; 355/3 R; 355/14 R; 355/55; 355/56

[58] Field of Search ..... 355/3 R, 14 R, 8, 55, 355/56, 3 DR

[56] References Cited

U.S. PATENT DOCUMENTS

| | | | |
|---|---|---|---|
| 4,264,186 | 4/1981 | Fujiwara et al. | 355/14 R |
| 4,453,824 | 6/1984 | Miyake et al. | 355/8 X |
| 4,456,366 | 6/1984 | Komiya et al. | 355/8 |
| 4,461,564 | 7/1984 | Ikenoue | 355/8 |
| 4,490,035 | 12/1984 | Sugiura | 355/8 |
| 4,494,866 | 1/1985 | Rattin et al. | 355/8 X |
| 4,519,697 | 5/1985 | Takeda et al. | 355/8 X |

FOREIGN PATENT DOCUMENTS 56-111867 2/1980 Japan .

*Primary Examiner*—A. C. Prescott

*Attorney, Agent, or Firm*—Cushman, Darby & Cushman

[57] ABSTRACT

A rotational velocity control apparatus of a document-scanning motor in a copying machine comprises a first velocity detector for detecting the rotational velocity of a photosensitive drum and for generating a signal of a frequency corresponding to the detected velocity, a frequency converter circuit for multiplying the frequency of the output signal from the first velocity detector and for frequency dividing the signal in accordance with a selected magnification, a second velocity detector for detecting the rotational velocity of a scanning motor and for generating a signal having a frequency corresponding to the detected velocity, and a motor controller for controlling the rotational velocity of the scanning motor such that the frequency of the output signal from the second velocity detector is proportional to that of the output signal from the frequency converter circuit. The frequency converter circuit has a phase locked loop control circuit having a frequency divider in its feedback loop, the frequency division ratio of which is changed in accordance with magnification. The motor controller also has in its feedback loop a frequency divider having a frequency division ratio which is changed in accordance with magnification. The proportional constant of the frequency of the output signal from the second velocity detector to that of the output signal from the frequency converter circuit is changed in accordance with the selected magnification.

8 Claims, 12 Drawing Figures

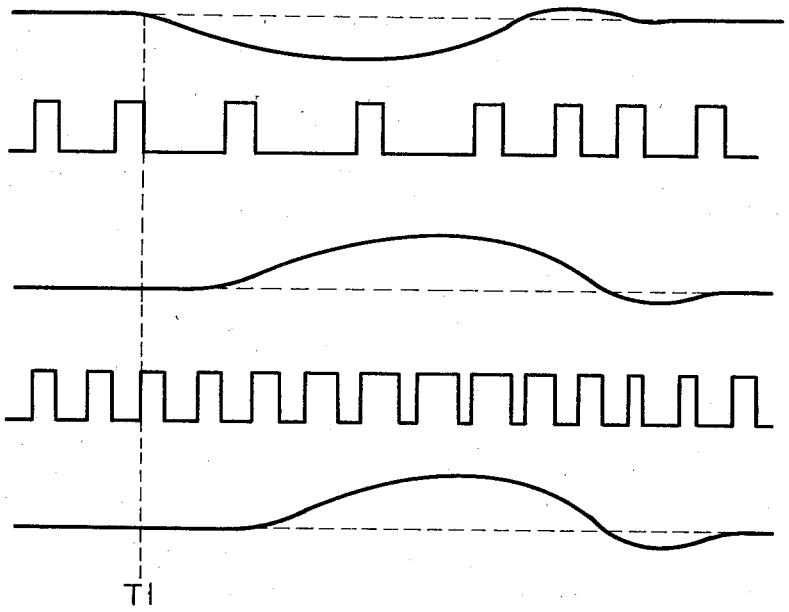
FIG. 7A (ROTATION SPEED)
FIG. 7B (S3 PULSE)
FIG. 7C (S7 SIGNAL)
FIG. 7D (S8 PULSE)
FIG. 7E (CONTROL VOLTAGE)

DOCUMENT-SCANNING CONTROL APPARATUS FOR IMAGE-FORMING APPARATUS

BACKGROUND OF THE INVENTION

The present invention relates to an image-forming apparatus such as a copying machine or a facsimile and, more particularly, a control apparatus for controlling the document-scanning velocity of such an image-forming apparatus.

In a copying machine of the document fixed type, a document set on a document table is exposed and scanned with an exposure lamp. An electrostatic latent image of the document is formed on a photosensitive drum as a photosensitive body with light reflected from the document. The photosensitive drum is rotated at a predetermined velocity. The scanning velocity of the exposure lamp is proportional to the rotational velocity of the photosensitive drum in accordance with a proportionality constant corresponding to copying magnification. A scanning velocity control circuit has been developed which detects the rotational velocity of the photosensitive drum and controls with reference to the detected velocity. A conventional circuit of this type is illustrated in FIG. 1.

A rotational velocity of a main motor 81 for driving a photosensitive drum 80 is detected by a velocity detector 82. An output signal from the velocity detector 82 is supplied to a frequency multiplier 83 and is multiplied with a coefficient to increase frequency. An output signal from the frequency multiplier 83 is supplied to a programmable frequency divider 84 to be frequency-divided thereby. The frequency divider 84 then produces a reference signal having a frequency corresponding to copying magnification. The reference signal is supplied to a phase comparator 85. A rotational velocity of a scanning motor 86 for driving a scanning means for optically scanning the document is detected by a velocity detector 87. An output signal from the velocity detector 87 is supplied to the phase comparator 85. The phase comparator 85 compares the phases of the reference signal from the frequency divider 84 and of the signal from the velocity detector 87, and supplies a comparison result signal to a driver 88. The driver 88 controls a drive signal to be supplied to the motor 86, in accordance with the output signal from the phase comparator 85. In order to achieve stable control, the frequency of the signal from the velocity detector 82 is increased by the frequency multiplier 83 and the frequency of the output signal from the frequency multiplier 83 is divided to provide a reference signal having a frequency corresponding to the copying magnification. The phase comparator 85 compares the reference signal with the signal from the velocity detector 87 so that the two signals have frequencies which are proportional to each other.

However, in the apparatus described above, a separate frequency multiplier and programmable frequency divider are used. Therefore, the number of circuit elements to be used is increased, and the resultant apparatus becomes expensive. Furthermore, since control is performed by changing the frequency of the reference signal in accordance with the copying magnification, the range of frequency change of the reference signal in accordance with the copying magnification is widened. The highest frequency at which the circuit can be operated is fixed. Then, a signal of low frequency may be used as a reference signal, so that stable control may not be performed.

SUMMARY OF THE INVENTION

The object of this invention is to provide a document-scanning control apparatus for an image-forming apparatus, which can reduce the number of circuit elements used, is inexpensive, and has an excellent control stability.

In order to achieve the above object of the present invention, a frequency multiplier and a programmable frequency divider are not arranged to be separate but are constituted by a frequency converting means comprising a single PLL (phase locked loop). A frequency divider having a switchable frequency division ratio is inserted in a feed-back signal path from a velocity detecting means in a velocity control loop of a scanning means. The range of frequency change of a reference signal is narrowed by a combination of such frequency division ratios.

BRIEF DESCRIPTION OF THE DRAWINGS

FIGS. 7A to 7E are timing charts showing the operation of the scanning motor control circuit shown in FIG. 4.

DETAILED DESCRIPTION OF THE EMBODIMENT

The preferred embodiment of the present invention will be described with reference to the accompanying drawings.

Figure 1:
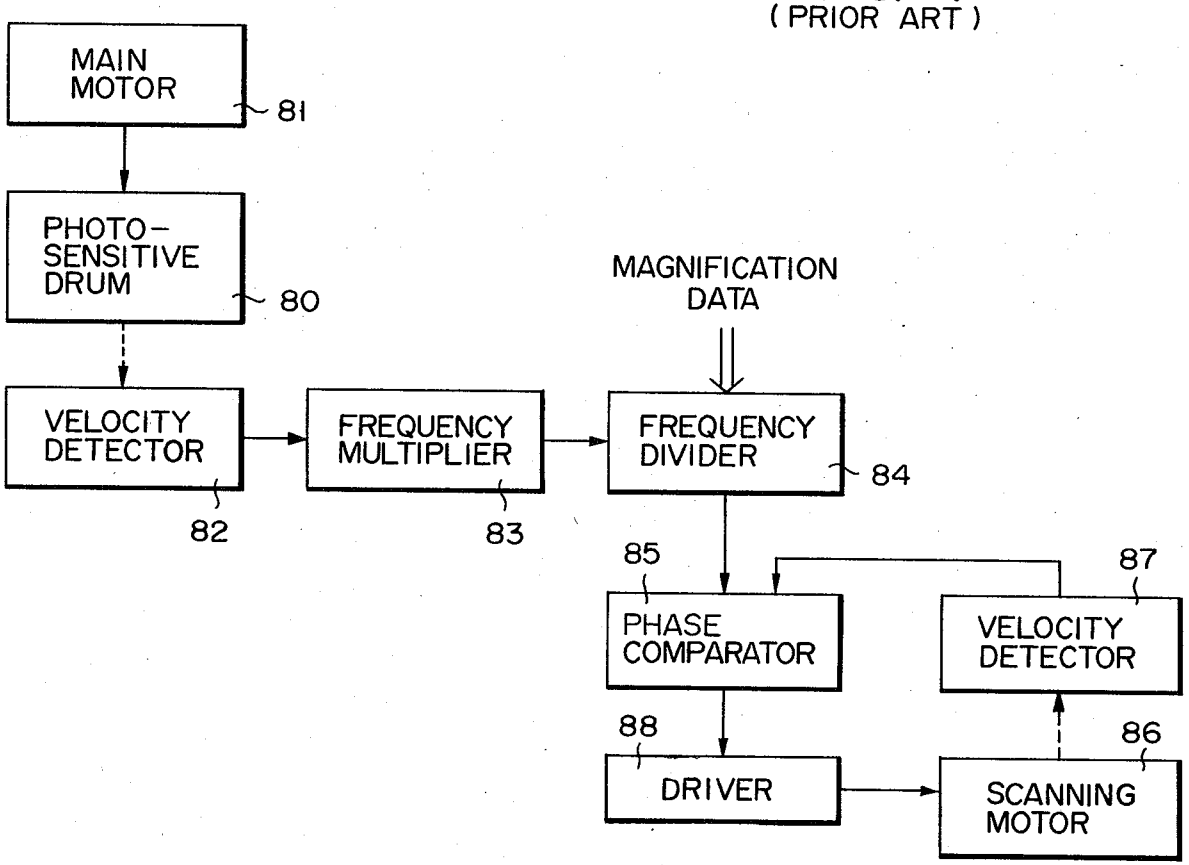
FIG. 1 (PRIOR ART)
FIG. 1 is a block diagram of a conventional document scanning velocity control circuit.
Figure 2:
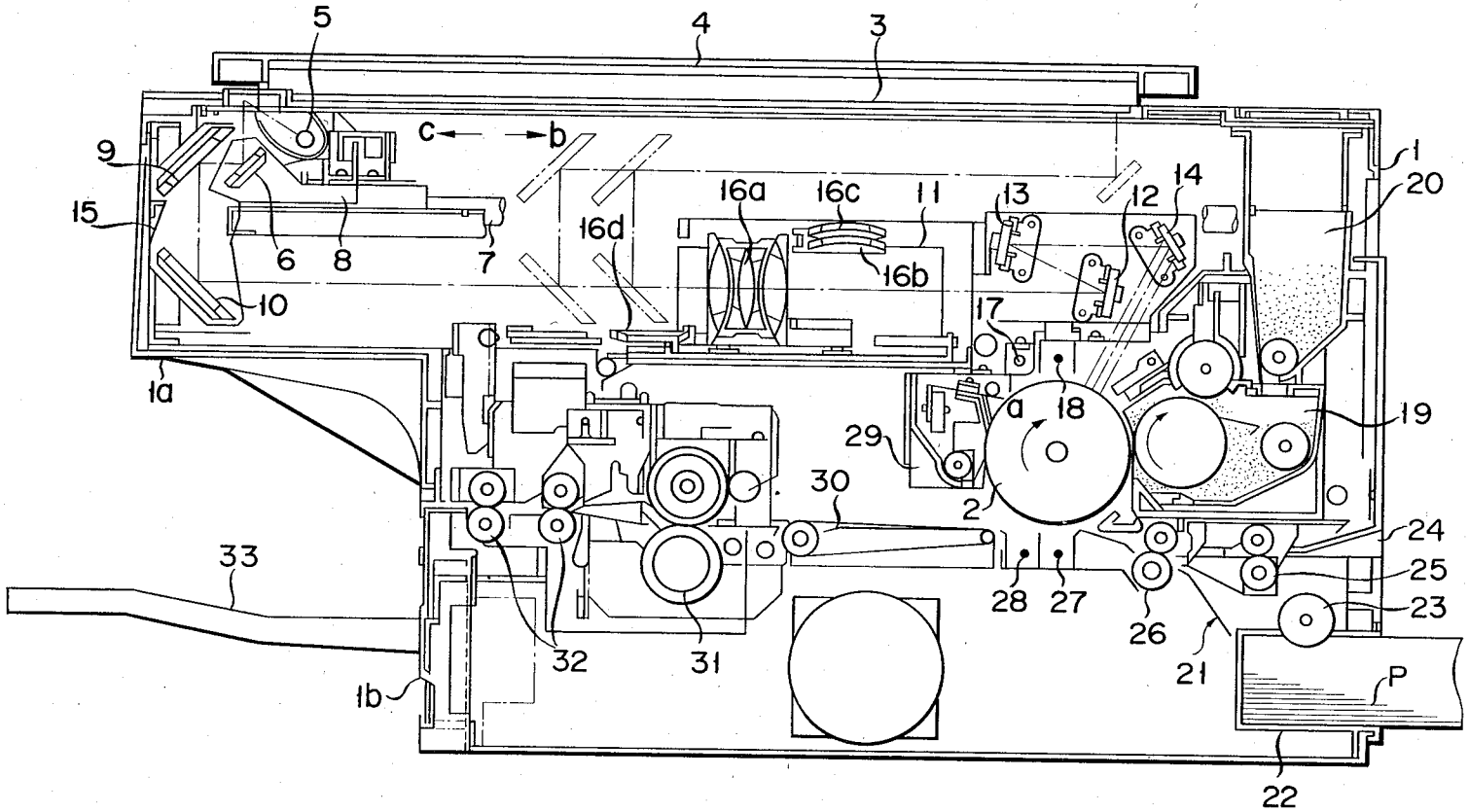
FIG. 2 is a sectional view showing the structure of a copying machine to which a document-scanning control apparatus according to the present invention is applied.

FIG. 2 shows an electronic copying machine of document fixed type as an example of an image-forming apparatus to which a document-scanning control apparatus according to the present invention is applied. A photosensitive drum 2 as an image carrier is arranged at substantially the center of a housing 1 and rotates in the direction indicated by arrow a. A document table 3 for supporting a document thereon is fixed at an upper portion of the housing 1. A document cover 4 is arranged on the document table 3 to be free to open or close. An exposure lamp 5 and a mirror 6 as a scanning means are arranged below the document table 3. The exposure lamp 5 and the mirror 6 are mounted on a first carriage 8 which can reciprocate along directions indicated by arrows b and c along a guide shaft 7. Thus, the exposure lamp 5 and the mirror 6 can optically scan from one end to the other of the document upon movement of the first carriage 8. The light emitted from the exposure lamp 5 and reflected by the document is guided to the surface of the photosensitive drum 2 through a lens unit 11 and fixed mirrors 12, 13 and 14, thereby slit-exposing the photosensitive drum 2. The mirrors 9 and 10 are mounted on a second carriage 15 which moves at a speed half that of the first carriage 8 therewith. The lens unit 11 comprises a main lens 16*a* which is movable along the directions indicated by arrows b and c, and magnification changing lenses 16*b*, 16*c* and 16*d* which are selectively arranged before and after the main lens 16*a* and which change the synthetic focal length of the overall lens system. The first and second carriages 8 and 15 are driven by single wires (not shown) which are looped around corresponding pulleys (not shown). The wires are driven by a scanning motor (not shown). The exposure lamp 5, the mirrors 6, 9 and 10, the lens unit 11 and the mirrors 12 to 14 constitute an optical system.

A discharge lamp 17 for discharging residual charge on the surface of the photosensitive drum 2 and a charger 18 for charging the surface of the photosensitive drum 2 are arranged around the surface of the photosensitive drum 2 along the direction of rotation thereof. The surface of the photosensitive drum 2 which is discharged and charged by the discharge lamp 17 and the charger 18 is exposed by the optical system to form an electrostatic latent image thereon. A developing unit 19 for visualizing the latent image on the photosensitive drum 2 with toner is arranged in front of the charger 18. A toner hopper 20 for supplying toner to the developing unit 19 is arranged above the developing unit 19. A sheet feed unit 21 for feeding a paper sheet to a position below the photosensitive drum 2 is arranged in front of the developing unit 19. The sheet feed unit 21 has a sheet feed cassette 22 which is detachable from the side of the housing 1 and stores paper sheets P therein, and a pickup roller 23 for picking each sheet P from the paper feed cassette 22. A manual sheet feed port 24 is formed above the paper feed cassette 22. A manual-/automatic sheet feed cassette (not shown) which allows either manual or cassette sheet feed is detachably mounted through a sheet feed mechanism (not shown) at the side of the housing 1 which corresponds to the manual sheet feed port 24. A pair of sheet feed roller 25 is also arranged at this side of the housing 1 to feed the sheet picked up from the manual/automatic sheet feed cassette in the forward direction. A pair of aligning rollers 26 are arranged next to the rollers 25 so as to feed the sheet from the cassette to an image transfer unit.

A transfer charger 27 and a separation charger 28 are arranged at the image transfer unit in front of the sheet feed unit 21. The transfer charger 27 transfers a toner image formed on the surface of the photosensitive drum 2 onto a paper sheet fed by the aligning rollers 26. The separation charger 28 electrostatically separates the sheet with the transferred image from the surface of the photosensitive drum 2. A cleaning unit 29 for recovering toner remaining on the surface of the photosensitive drum 2 is arranged in front of the separation charger 28.

A convey unit 30 for conveying the sheet separated from the photosensitive drum 2 is arranged in the vicinity of the separation charger 28. A heat roller 31 as a fixer for fixing the transferred image on the conveyed sheet is arranged at a terminal end of the convey unit 30. The sheet with the fixed image is discharged to a discharge tray 33 outside the housing 1 by a pair of discharging rollers 32.

The housing 1 is split into an upper casing 1*a* and a lower casing 1*b* having the convey unit 30 at a boundary. Both the casings 1*a* and 1*b* are pivotally supported at a pivot shaft (not shown) at one end of the housing 1, such that the casing 1*a* can be opened through a predetermined angle. The following members are included in the upper casing 1*a*: the photosensitive drum 2, the document table 3, the optical system, the charger 18, the developing unit 19, the pickup roller 25, the upper aligning roller 26, the cleaning unit 29, the heat roller 31, and the upper discharge roller 32. Similarly, the following members are arranged inside the lower casing 1*b*: the sheet feed cassette 22, the sheet feed roller 23, the pickup roller 25, the lower aligning roller 26, the chargers 27 and 28, the convey unit 30, the heat roller 31, the lower discharge rollers 32 and the discharge tray 33.

Although not shown in the drawing, position detecting switches SW1 to SW4 which are turned on or off in accordance with the position of the second carriage 15 are arranged in the path of the second carriage 15. Note that the switch SW1 detects the scanning start position (position indicated by the solid line in FIG. 2) of the carriage 15. The switch SW2 detects that the carriage 15 has reached the position at a predetermined distance from the switch SW1. The switch SW3 detects that the carriage 15 has reached its movement limit position when an enlarged image is reproduced. The switch SW4 detects that the carriage 15 has reached its movement limit position when an equal magnification image is reproduced.

Figure 3:
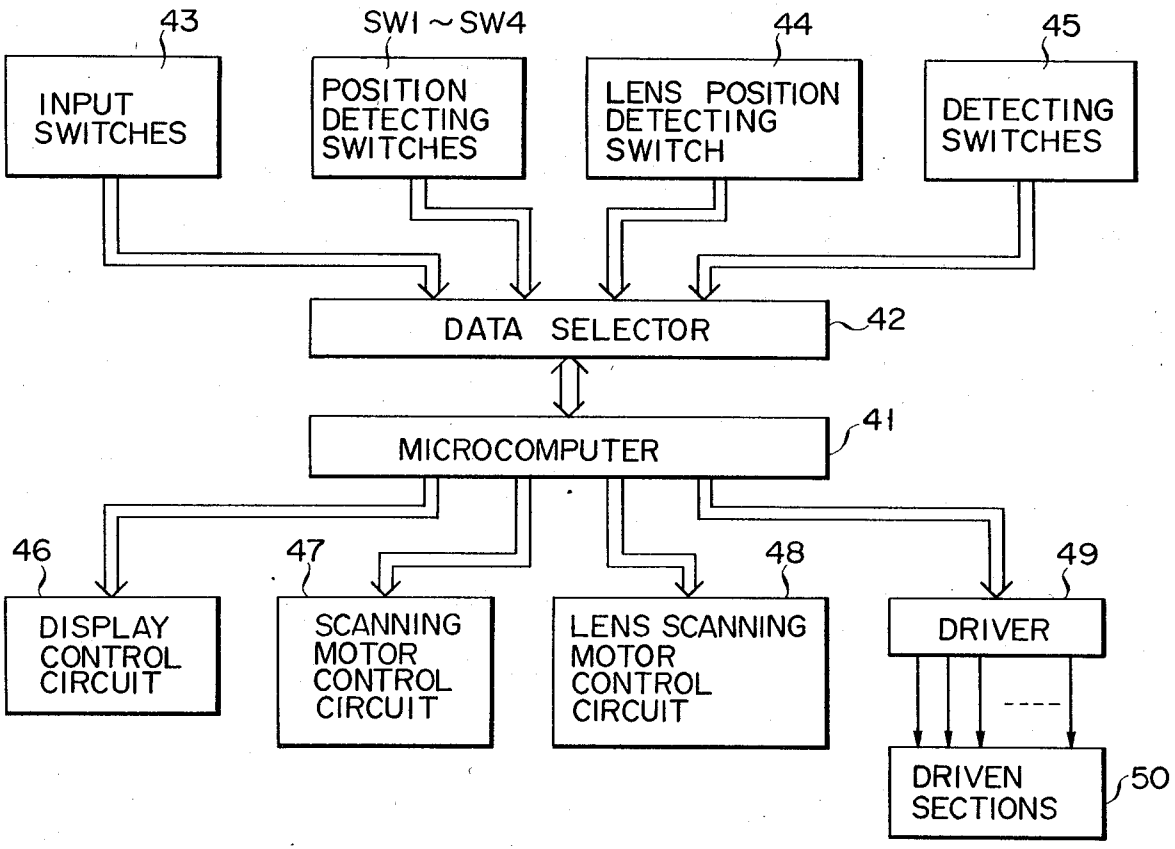
FIG. 3 is a block diagram of a control circuit of the copying machine shown in FIG. 2.

FIG. 3 schematically shows the overall control system. A microcomputer 41 as a main control section controls the overall copying machine. Input ports of the microcomputer are connected through a data selector 42 to input switches 43 such as various keys arranged on a control panel, the position detecting switches SW1 to SW4, a lens position detecting switch 44 for detecting the position of the main lens 16*a*, and other detecting switches 45. Output ports of the microcomputer are connected to a display control circuit 46 for controlling various displays, a scanning motor control circuit 47 for controlling the scanning motor for driving the carriage, a lens scanning motor control circuit 48 for moving the main lens 16*a*, and the like. Various driven sections 50 such as chargers, solenoids, or clutches are connected to another output port of the microcomputer through a driver 49.

Figure 4:
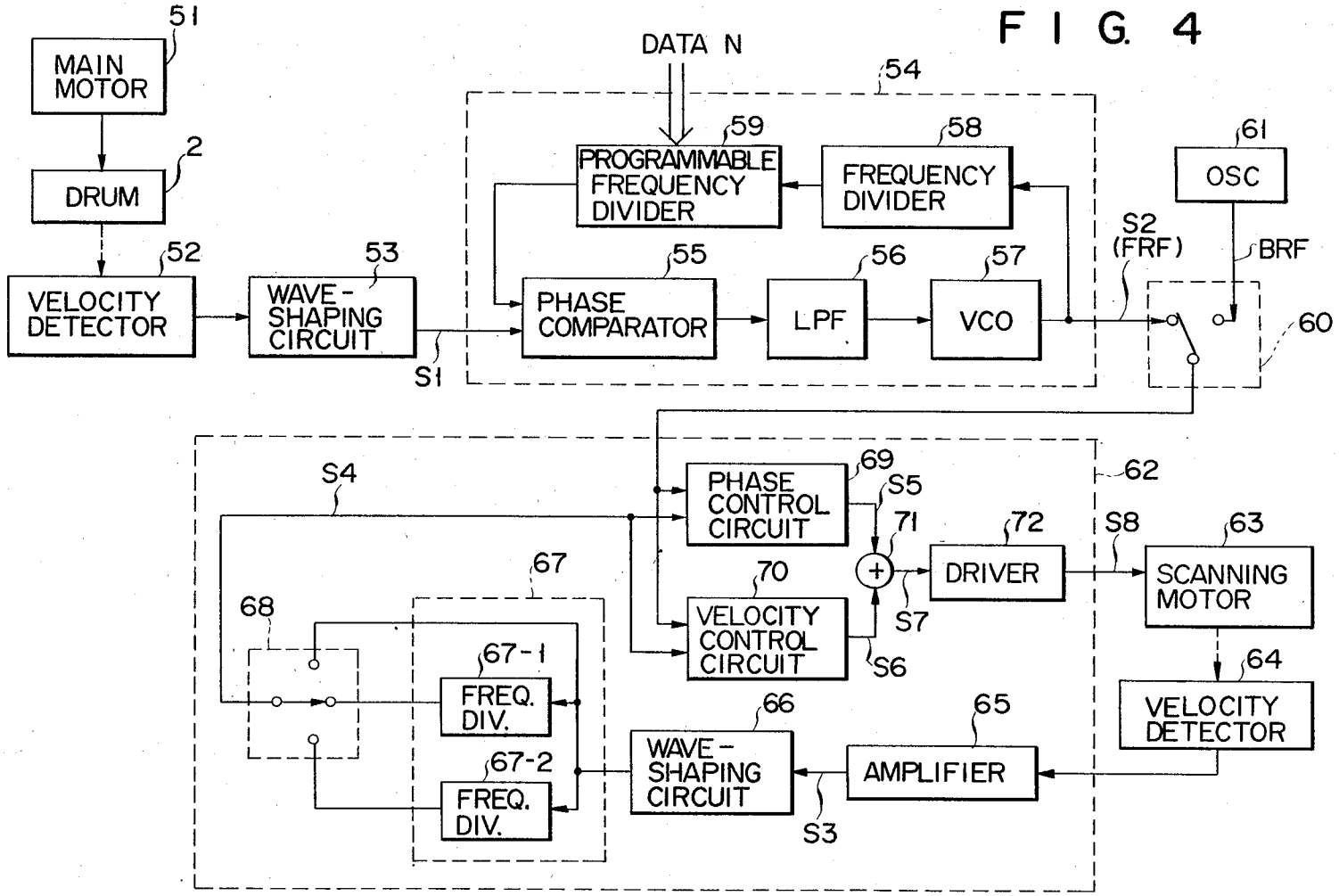
FIG. 4 is a block diagram of a scanning motor control circuit in FIG. 3 showing an embodiment of a document-scanning control apparatus according to the present invention.

FIG. 4 is a detailed block diagram of the scanning motor control circuit 47 in FIG. 3. Rotation of a main motor 51 is transmitted to the photosensitive drum 2 through a rotational force transmission mechanism (not shown). Then, the photosensitive drum 2 is driven at a constant speed during exposure of the document. The rotational velocity of the photosensitive drum 2 is detected by a velocity detector 52 comprising a pulse encoder. The velocity detector 52 consists of a timing disk (disk with a radial slit) rotating at a velocity proportional to the rotational velocity of the photosensitive drum 2, and a photointerruptor for detecting the radial slit of the disk. The velocity detector 52 produces a pulse signal (to be referred to as a sync pulse) of about 78 Hz when the rotational velocity of the photo sensitive drum 2 is stable. The sync pulse is shaped by a wave-shaping circuit 53. An output pulse S1 from the wave-shaping circuit 53 is supplied to a frequency converter 54. The frequency converter 54 multiplies the frequency of the input pulse signal S1 by 64N (N will be described later) and produces the product. An output pulse signal S2 from the frequency converter 54 is a reference pulse signal FRF for controlling the forward movement of the carriages 8 and 15. As will be described later, in this embodiment, the frequency of the pulse signal FRF changes within a relatively narrow range of 0.7 to 1.085 when the magnification falls within the range of 1/1.54 to 1/0.65 (one side length of document/one side length of copy).

The frequency converter 54 is a phase locked loop (PLL) circuit consisting of a phase comparator 55, a low-pass filter 56, a voltage-controlled oscillator (VCO) 57, a frequency divider 58, and a programmable frequency divider 58. The output pulse signal S2 from the VCO 57 is frequency divided at a ratio of 1/64 by the frequency divider 58 and is then frequency divided again at a ratio of 1/N by the programmable frequency divider 59. Note that N herein is data supplied from the microcomputer 41. Thus, the phase comparator 55 compares the phase of the output pulse signal S1 from the wave-shaping circuit 53 and the pulse signal obtained by frequency dividing the output pulse signal S2 from the VCO 57 at a ratio of 1/64N. The phase comparator 55 produces a tristate pulse signal proportional to the phase difference between the two input pulses. When the phase of the pulse signal S1 is advanced with respect to that of the other input signal, the tristate signal is a signal of a voltage of 0 V. When the phase of the pulse signal S1 is lagged from that of the other, the tristate signal is a signal of a voltage of +5 V. When the two input signals are in phase, the tristate pulse signal has a floating level. An output from the phase comparator 55 is integrated by the low-pass filter 56 and the integrated signal is supplied to the VCO 57. If the signal obtained by 1/64N frequency division of the pulse signal S2 is lagged from the pulse signal S1, an output from the phase comparator 55 is a signal of 0 V corresponding to the phase difference. Then, the output voltage from the low-pass filter 56 is increased, and the frequency of the output pulse signal S2 from the VCO 57 is increased. The phase lag is decreased, and finally the two input pulses to the phase comparator 55 are in phase. As a result, the frequency of the pulse signal S1 becomes equal to that of the pulse signal obtained by 1/64N frequency division of the pulse signal S2. The frequency of the pulse signal S1 becomes 1/64N that of the pulse signal S2.

Figure 5:
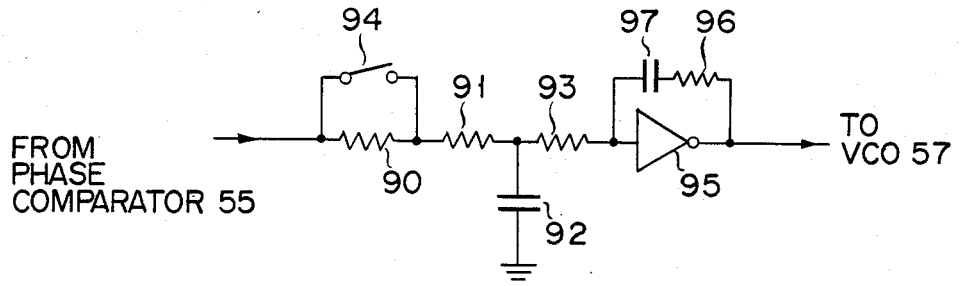
FIG. 5 is a detailed circuit diagram of a low-pass filter in FIG. 4.

FIG. 5 shows a detailed circuit diagram of the low-pass filter 56. The low-pass filter 56 has an RC integration circuit consisting of resistors 90 and 91 and a capacitor 92. The time constant of the RC integration circuit is variable in accordance with the ON/OFF operation of a switch 94 connected in parallel with the resistor 90. The switch 94 is off during the exposure of the document and is on in any other mode. Output from the integration circuit is supplied to the VCO 57 through a resistor 93 and an amplifier 95. Output from the amplifier 95 is fed back to its input through a resistor 96 and a capacitor 97. Then, during the document's exposure, the time constant of the integration circuit is set to be long. Therefore, the adverse effects of the irregular rotation of the main motor 51, variations in detection operation of the velocity detector 52, and the like are eliminated. In any other mode, for example, after the main motor 51 starts rotating upon being powered and until the copying operation is started, the output signal from the VCO 57 can be stabilized within a short period of time, since the time constant is set to be short.

The output pulse signal S2 (FRF) from the frequency converter 54 is supplied to a selector 60. The selector 60 also receives an output pulse from an oscillator 61 as a reference pulse signal BRF (1.125 MHz herein) for controlling the backward movement of the carriages 8 and 15. As will be described later, the carriages can be moved backward at a high speed four times that corresponding to the reference pulse. In accordance with whether or not the carriages 8 and 15 are moving forward or backward, the selector 60 selects one of the reference pulse signal FRF (S2) and the reference pulse signal BRF and supplies the selected signal to a motor controller 62. The motor controller 62 controls a document scanning motor (e.g., a DC brushless motor) 63 in accordance with the reference pulse signal selected by the selector 60. The motor controller 62 rotates a scanning motor 63 in synchronism with the reference pulse signal by phase control (PLL control) for synchronizing the reference pulse signal and the rotational velocity detection signal of the scanning motor 63 and by velocity control for coinciding the frequencies of these signals. The rotational velocity of the scanning motor 63 is detected by a velocity detector 64 comprising a pulse encoder. The velocity detector 64 comprises a frequency generator for generating a signal of a frequency corresponding to the detected velocity. An output pulse signal from the velocity detector 64 is amplified by an amplifier 65. An output pulse signal S3 from the amplifier 65 is a pulse signal having a frequency proportional to the rotational velocity of the scanning motor 63. The pulse signal S3 is shaped by a wave-shaping circuit 66 and the shaped signal is supplied to a frequency divider circuit 67.

Figure 6A:
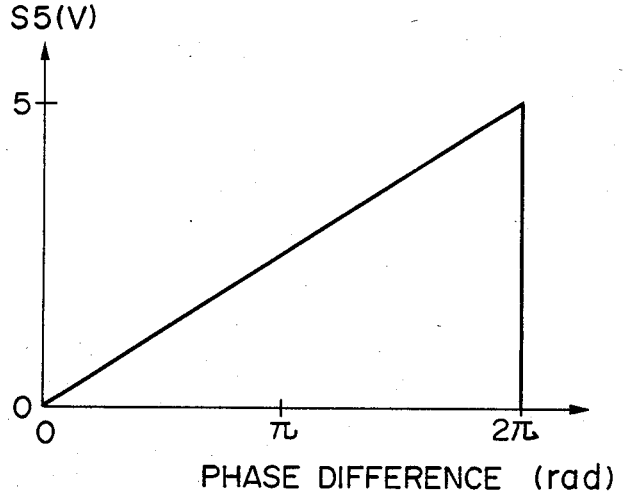
FIGS. 6A and 6B are graphs showing input/output characteristics of a phase control circuit and a velocity control circuit in FIG. 4.

The frequency divider circuit 67 frequency divides the output signal from the wave-shaping circuit 66 at ratios of 1/1, ½ and ¼ and produces three output pulses. For this purpose, the frequency divider 67 has a ½ frequency divider 67-1 and a ¼ frequency divider 67-2. The three output pulse signals from the frequency divider circuit 67 are supplied to a selector 68. The selector 68 selects a 1/1 frequency division output when the carriages are moving in the forward direction and the selected magnification indicates an enlargement, or when the carriages are moving backward and at low speed. The selector 68 selects a ½ frequency division output when the carriages are moving in the forward direction and the selected magnification indicates an equal magnification or a reduction. The selector 68 selects a ¼ frequency division output when the carriages move backward at a high speed. An output pulse signal S4 from the selector 68 is supplied to a phase control circuit (PLL circuit) 69 to perform the above-mentioned phase control and to a velocity control circuit 70 to perform the above-mentioned velocity control. An output reference pulse signal from the selector 60 is also supplied to the phase control circuit 69 and the velocity control circuit 70. The phase control circuit 69 frequency divides the input reference pulse signal at a ratio of 1/2560, compares the phases of this signal and the pulse signal S4, and produces an analog voltage signal S5 proportional to the phase difference. FIG. 6A shows the input/output characteristics of the phase control circuit 69. The velocity control circuit 70 frequency divides the input reference pulse at a ratio of 1/2560, compares the frequencies of this signal and the pulse signal S4, and produces an analog voltage signal S6 proportional to the frequency difference. When the period of the pulse signal S4 is +4.6% or more of the period of the signal obtained by frequency division of the reference signal at a ratio of 1/2560, an output signal S6 from the velocity control circuit 70 is fixed at 0 V.

Figure 6B:
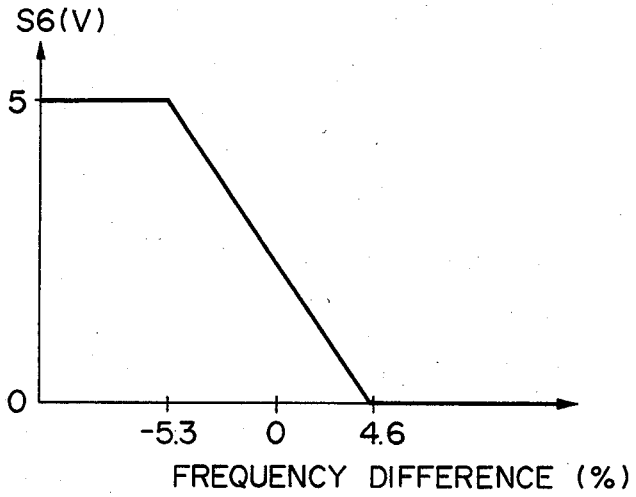

When the period of the pulse signal S4 is −5.3% or less of that of the signal obtained by frequency dividing the reference signal at a ratio of 1/2560, an output signal S6 from the velocity control circuit 70 is fixed at +5 V. FIG. 6B shows the input/output characteristics of the velocity control circuit 70.

The output signal S5 from the phase control circuit 69 and the output signal S6 from the velocity control circuit 70 are added by an adder 71 at a ratio of 1:1. An analog signal S7 from the adder 71 is supplied to a motor driver 72. The motor driver 72 performs pulse-width modulation of the input signal and supplies a pulse signal of a pulse width corresponding to the input voltage to the scanning motor 63 as a control signal S8. The scanning motor 63 is rotated at a rotational velocity corresponding to the effective value of the input pulse voltage. The rotational direction of the scanning motor 63 is forward when the carriages are moving forward and is backward when the carriages are moving backward. The rotational velocity of the scanning motor 63 is detected by the velocity detector 64 and the detected velocity is fed back to the motor controller 62.

With this configuration, control is performed such that the pulse signal S4 and the signal obtained by frequency division of the reference pulse signal at a ratio of 1/2560 are in phase. Thus, the scanning motor 63 is controlled to rotate at one of the velocities proportional to the frequencies once, twice and four times that of the reference pulse in accordance with the selection operation of the frequency divider 67.

The control procedures for controlling the velocity of the scanning motor 63 at a preset velocity during the forward movement of the carriages (during exposure of the document) in this embodiment will be described with reference to the timing chart shown in FIGS. 7A through 7E. FIG. 7A shows the rotational velocity of the scanning motor 63. FIG. 7B shows the output pulse signal S3 of the amplifier 65 obtained by amplifying the detection output from the velocity detector 64. Assume that the rotational velocity of the scanning motor 63 drops at time T1 for some reason. Then, the frequency of the output signal S3 from the amplifier 65 shown in FIG. 7B is decreased. Therefore, irrespective of the signal selected by the selector 68, the phase and frequency of the output signal S4 from the selector 68 are lagged and are smaller than those of the reference signal. Therefore, the output signal S7 from the adder 71 is increased in amplitude, as shown in FIG. 7C. As a result, as shown in FIG. 7D, the on time of the output signal S8 of the motor driver 72 is increased, and the effective value of the voltage applied to the scanning motor 63 is increased, as shown in FIG. 7E. The rotational velocity of the scanning motor 63 is increased and returns to the original velocity.

The relationship between the selection operation of the selector 68 and the rotational velocity of the scanning motor 63 will be described below. The detection output S3 from the velocity detector 64 is frequency divided at ratios of 1/1, ½ and ¼. One of the outputs from the frequency divider 67 is selected by the selector 68 and is supplied to the phase control circuit 69 and the velocity control circuit 70. As a result, in the respective cases, the frequency of the reference signal is substantially increased to values once, twice or four times the original value. As a result, the rotational velocity of the scanning motor 63 becomes a reciprocal of the frequency division ratio selected by the selector 68. Assume that the selector 68 selects an output from the ½ frequency divider 67-1. In this case, the phase control circuit 69 and the velocity control circuit 70 synchronize the 1/2560 frequency-divided signal of the reference signal and the ½ frequency-divided signal as the detection signal of the velocity detector 64. Similarly, assume that the selector 68 selects the output from the wave-shaping circuit 66. In this case, the phase control circuit 69 and the velocity control circuit 70 synchronize the 1/2560 frequency-divided signal of the reference signal and the detection signal from the velocity detector 64. In this case, if the same reference signal is used, the frequency of the output S4 from the selector 68 must also be same. That is, the frequency of the velocity detection pulse S3 when the selector 68 selects the 1/1 ratio and the frequency of the ½ frequency-divided signal thereof when the selector 68 selects the ½ ratio must be the same. Since the number of pulses from the velocity detector 64 per revolution of the scanning motor 63 is constant, the rotational velocity when the ½ ratio is selected must be twice that when the 1/1 ratio is selected in order to satisfy the above condition. In this manner, the rotational velocity of the scanning motor 63 can be changed by the selection operation of the selector 68 without changing the frequency of the reference signal.

The rotational velocity of the scanning motor 63 must be changed in accordance with a selected magnification. Rotational velocity control of the scanning motor 63 in accordance with the selected magnification will be described below. As described above, the rotational velocity of the scanning motor 63 can be changed by changing the selection operation of the selector 68 but does not correspond to the magnification. The reference signal S2 (FRF) during the forward movement of the carriages is obtained as a result of PLL control. Therefore, the frequency of the reference signal S2 can be changed in accordance with the magnification by changing the frequency division ratio (1/N) of the variable frequency divider 59 in the PLL loop. Note that the magnification in the document scanning direction is changed by the rotational velocity of the scanning motor 63, and the magnification in a direction perpendicular to the document scanning direction is changed by the optical system. Five magnifications (one side length of copy/one side length of document) are considered here: 1.54 (to be referred to as E2 hereinafter), 1.29 (to be referred to as E1 hereinafter), 1.0 (to be referred to as an equal magnification hereinafter), 0.78 (to be referred to as R1 hereinafter), and 0.65 (to be referred to as R2 hereinafter). If the rotational velocity of the scanning motor 63 is controlled only in accordance with changes in the frequency of the reference signal S2, the frequency of the reference signal S2 must be set to be 0.65 (=1/1.54), 0.78, 1.28, and 1.54 for E2, E1, R1 and R2 if the frequency for an equal magnification is represented by 1. In other words, the range of frequency change of the reference signal is as wide as 0.65 to 1.54.

When control stability is considered, the updating period of the output voltages from the phase control circuit 69 and the velocity control circuit 70 is preferably short. For this reason, the frequency of the reference signal is preferably high. Since the operation frequency upper limit is present, the range of frequency change of the reference frequency is preferably narrow so as to allow operation at high frequencies.

In view of the above, in this embodiment, the frequency divider circuit 67 is incorporated in the control loop for controlling the detection signal from the scanning motor 63. In the cases of E2 and E1, control is performed such that the detection signal from the scanning motor 63 is synchronized with the 1/2560 frequency-divided signal of the reference signal. In the cases of the equal magnification, R1 and R2, control is performed such that the detection signal from the scanning motor 63 is synchronized with the 2/2560 frequency-divided signal of the reference signal. As a result, in the cases of E2 and E1, if the frequency of the reference signal for the equal magnification is determined by 1, the frequency of the reference signal becomes $0.65\times2=1.30$ and $0.78\times2=1.55$. In the cases of R1 and R2, the frequency becomes 1.28 and 1.54 as described above. Therefore, the reference signal has a frequency change range of 1 to 1.55. For the purpose of comparison, if the frequency for the equal magnification is determined to be 0.7, a frequency change range of 0.7 to 1.085 ($=1.55\times0.7$) is obtained. In this manner, according to this embodiment, the range of frequency change of the reference signal is narrow when the magnification is changed. Therefore, the frequency of the reference signal in the enlargement mode can be increased, and the control stability can be improved.

Frequency division data N supplied to the variable frequency divider 59 when the magnification is set in this manner will be described later. The reference signal has a frequency proportional to N. Then, when the coefficient during the equal magnification is represented by K, the frequency of the reference signal becomes values obtained by rounding $1.30\times K$, $1.55\times K$, $1.28\times K$, and $1.54\times K$. That is, the frequency is a value obtained by rounding $N=2K/XY$ where Y is the inverse number of the frequency division ratio of the frequency divider circuit 67, i.e., the ratio of input frequency/output frequency.

When the carriages move backward, the scanning motor 63 need not be synchronized with the rotational velocity of the photosensitive drum 2. Therefore, the signal of a constant frequency is used as a reference signal. In order to prevent damage to the carriage or deformation thereof and to shorten the time required for backward movement of the carriages, the carriages are controlled by low-speed backward movement and high-speed backward movement at a high speed which is four times the low speed by the frequency divider circuit 67 and the selector 68.

With the configuration described above, the scanning motor control circuit 47 includes the PLL frequency converter 54 which obtains a reference signal by frequency converting the signal from the velocity detector 52 for detecting the rotational velocity of the photosensitive drum 2. The programmable frequency divider 59 is arranged in the feedback signal path of the PLL cirucit to allow switching of the conversion frequency. The variable frequency divider 67 is also inserted in the feedback signal path of the motor controller 62. The frequency division ratio of the frequency divider 67 is properly selected to change the proportional constant between the frequency of the reference signal and that of the output signal from the velocity detector 64. In this manner, without requiring a separate frequency multiplier and programmable frequency divider as is conventional, the frequency converter 54 comprising a PLL circuit can provide the same functions. Therefore, the number of circuit elements used can be reduced and the cost of the overall apparatus can be reduced. In addition, the range wherein the frequency of the reference signal must be changed in accordance with the magnification can be narrowed. Therefore, the frequency of the reference signal can be in the vicinity of the upper limits of the operating frequency, thereby improving control stability.

The above embodiment is described with reference to a case wherein the present invention is applied to an electronic copying machine of a document fixed type. However, the present invention can be similarly applied to an electronic copying machine of a document table moving type. In this case, the position of the exposure lamp and the mirrors is fixed, and the document table is moved.

Furthermore, in the above embodiment, the present invention is applied to a document-scanning control apparatus of an electronic copying machine. However, the present invention is not limited to this and can be similarly applied to document-scanning control apparatuses for other types of image-forming apparatuses such as a facsimile or a color copying machine.

What is claimed is:

1. A document-scanning control apparatus for an image-forming apparatus, comprising:

scanning means for moving relative to a document and for scanning and optically reading the document;

a photosensitive body which is moved upon a relative movement between the document and said scanning means and on which an image of the document obtained by said scanning means is formed; and control means for synchronizing a scanning velocity of said scanning means with movement of said photosensitive body, the control means including:

first velocity detecting means for detecting a moving velocity of said photosensitive body and for generating a signal of a frequency corresponding to the detected moving velocity;

frequency converting means for converting a frequency of an output signal from said first velocity detecting means into a high frequency corresponding to a magnification of a formed image;

second velocity detecting means for detecting the scanning velocity of said scanning means and for generating a signal of a frequency corresponding to the detected scanning velocity; and motor controller for controlling the scanning velocity of said scanning means so that the frequency of an output signal from said second velocity detecting means is proportional to that of an output signal from said frequency converting means.

2. An apparatus according to claim 1, wherein said frequency converting means is a phase locked loop control circuit having a frequency divider in a feedback loop thereof, a frequency division ratio of the frequency divider is changed in accordance with the magnification of the formed image.

3. An apparatus according to claim 2, wherein said phase locked loop control circuit has a low-pass filter having a variable time constant, and the time constant of said low pass filter is set to be longer during image formation on said photosensitive body than in any other interval.

4. An apparatus according to claim 1, wherein said motor controller comprises a velocity control circuit for matching a frequency of a signal obtained by frequency division of the output signal from said second velocity detecting means with that of the output signal from said frequency converting means, and a phase control circuit for synchronizing the phases of the signal obtained by frequency division of the output signal from said second velocity detecting means and the output signal from said frequency converting means, and a sum of outputs from said velocity control circuit and said phase control circuit is supplied to said scanning means as a control signal.

5. An apparatus according to claim 4, wherein said motor controller has in a feedback loop thereof a frequency divider circuit, a frequency division ratio of which is changed in accordance with the magnification of the formed image, and a proportional constant of the frequency of the output signal from said second velocity detecting means to that of the output signal from said frequency-converting means is changed by changing the frequency division ratio of said frequency divider.

6. An apparatus according to claim 5, wherein the frequency division ratio of said frequency divider circuit is not less than one when the magnification of the formed image is less than one.

7. An apparatus according to claim 6, wherein said frequency divider circuit comprises a plurality of frequency dividers having different frequency division ratios and a selector for selecting one of said plurality of frequency dividers.

8. An apparatus according to claim 1, wherein said first and second velocity detecting means comprise pulse encoders.

* * * * *